US010038270B2

(12) United States Patent
Fabre et al.

(10) Patent No.: US 10,038,270 B2
(45) Date of Patent: Jul. 31, 2018

(54) ELECTRICAL CONNECTION DEVICE AND METHOD FOR MOUNTING AN ELECTRICAL CONNECTION DEVICE

(71) Applicant: Delphi International Operations Luxembourg S.A.R.L., Bascharage (LU)

(72) Inventors: Jean Fabre, Chartres (FR); Matthieu Huguet, St Cyrl'ecole (FR)

(73) Assignee: Delphi International Operations Luxembourg Sarl, Luxembourg (LU)

( * ) Notice: Subject to any disclaimer, the term of this patent is extended or adjusted under 35 U.S.C. 154(b) by 1 day.

(21) Appl. No.: 15/404,239

(22) Filed: Jan. 12, 2017

(65) Prior Publication Data

US 2017/0207564 A1 Jul. 20, 2017

(30) Foreign Application Priority Data

Jan. 20, 2016 (FR) ..... 16 50456

(51) Int. Cl.
*H01R 13/426* (2006.01)
*H01R 13/436* (2006.01)
*H01R 13/645* (2006.01)

(52) U.S. Cl.
CPC ..... *H01R 13/426* (2013.01); *H01R 13/4361* (2013.01); *H01R 13/645* (2013.01); *H01R 2201/26* (2013.01)

(58) Field of Classification Search
CPC ..... H01R 2201/26; H01R 13/426; H01R 13/4361; H01R 13/5208; H01R 13/565; H01R 13/62927
See application file for complete search history.

(56) References Cited

U.S. PATENT DOCUMENTS 1,420,675 A * 6/1922 Andreae ..... H01M 2/06 429/183
1,472,391 A * 10/1923 Ford ..... H01M 2/06 429/181

(Continued)

FOREIGN PATENT DOCUMENTS

DE 102013102647 A1 9/2014

OTHER PUBLICATIONS

English Translation of DE 10 2013 102 647.*

*Primary Examiner* — Michael A Lyons
*Assistant Examiner* — Matthew T Dzierzynski
(74) *Attorney, Agent, or Firm* — Robert J. Myers

(57) ABSTRACT

An electrical connection device includes a housing with a tubular cavity and a contact having a first portion and a second portion. The first portion has a cylindrical first external surface oriented about a longitudinal axis and is inserted into the tubular cavity of the housing. The second portion extends outside the tubular cavity and has an orientation zone with a second external surface that is partially, but not completely, cylindrical about the longitudinal axis. The electrical connection device further includes an anti-rotation device, displaceable in translation up to a final position, and having a first surface complementary to the second external surface of the orientation zone and abutting thereon when the anti-rotation device is in the final position and the contact is oriented in an operating position. A method of mounting such an electrical connection device is also provided.

9 Claims, 4 Drawing Sheets

(56) References Cited

U.S. PATENT DOCUMENTS

| | | | | |
|---|---|---|---|---|
| 4,775,604 | A * | 10/1988 | Dougherty | H01M 2/06 429/178 |
| 7,575,476 | B2 * | 8/2009 | Tyler | H01R 13/66 439/607.04 |
| 8,192,212 | B2 * | 6/2012 | Casses | B60L 11/1818 439/181 |
| 8,827,729 | B2 * | 9/2014 | Gunreben | H01R 13/658 439/188 |
| 9,425,541 | B2 * | 8/2016 | Data | H01R 24/28 |
| 9,601,863 | B2 * | 3/2017 | Takemura | H01R 13/5202 |

* cited by examiner

ELECTRICAL CONNECTION DEVICE AND METHOD FOR MOUNTING AN ELECTRICAL CONNECTION DEVICE

CROSS-REFERENCE TO RELATED APPLICATION

This application claims the benefit under 35 U.S.C. § 119(a) of Patent Application No. 1650456 filed in the Institut National de la Propriété Industrielle (French Patent Office) on Jan. 20, 2016, the entire disclosure of which is hereby incorporated by reference.

TECHNICAL FIELD OF THE INVENTION

The invention relates to an electrical connection device. A device of this type can be used in electric vehicles circuits for example, and more particularly, in electrical power circuits such as those interconnecting with one another, in electric or hybrid vehicles, elements such as a battery, a motor, a voltage converter, etc.

BACKGROUND OF THE INVENTION

An electrical connection device comprises one or more contacts, or pins, mounted in a housing and electrically connected to one or more cables, or one or more bus bars, for example. In this case, the contacts used in this kind of connection often have a rod or bar, having a portion with a cylindrical external surface of revolution about a longitudinal axis. If this cylindrical surface of rotation is inserted into a cavity of the housing of complementary shape, i.e. tubular and cylindrical, the contact having this cylindrical portion can potentially turn in its cavity, about its longitudinal axis. In this case, it may happen that another portion of the contact, intended to be connected to a bus bar for example, is no longer oriented correctly to cooperate with and/or be connected to thereto.

This incorrect orientation can lead to complications when securing or connecting the contact to another conductive element (e.g. a bus bar or a cable). An additional, often manual, operation is necessary to rotate the contact and give it in an orientation suitable for connection with the other element. However, this orientation operation, which may be imprecise and does not completely solve the problems, can also result in a loss of productivity.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to a first embodiment of this invention, an electrical connection device is provided. One purpose of this electrical connection device is to block the contact in an appropriate orientation for its mechanical or electrical connection with another element (bus bar or cable, for example). Optionally, another purpose is to obtain an orientation of the contact about the longitudinal axis of its cylindrical portion of revolution (inserted into the tubular cavity of the housing), which does not depend on the precision provided by an operator to reorient the contact in its tubular cavity.

At least one of these purposes is at least partly achieved with an electrical connection device having:

a housing with at least one tubular cavity, and at least one contact having a first and a second portion.

The first portion has a cylindrical external surface of revolution about a longitudinal axis and is inserted into the tubular cavity of the housing. The second portion extends outside the tubular cavity and includes an orientation zone with an external surface that is not completely cylindrical of revolution about the longitudinal axis. In other words, the second portion comprises at least one zone (referred to as the "orientation zone" in this document, but this zone can have another function in addition to orienting the contact about the longitudinal axis) whose external surface is not completely symmetrical, and at least not symmetrical in revolution, about the longitudinal axis.

Furthermore, the connection device comprises an anti-rotation device. This anti-rotation device is displaceable in translation along a placement direction, up to a final position (in which the electrical connection device can be connected to at least a bus bar or a cable). The placement direction of anti-rotation device is substantially perpendicular to the longitudinal axis of the first portion of contact. The anti-rotation device has at least one surface complementary to the external surface of the orientation zone. This complementary surface abuts the external surface of the orientation zone, when the anti-rotation device is in final position and when the contact is oriented in an operating position, i.e. in the desired position or orientation (around the longitudinal axis) for its connection to at least one other element (bus bar or cable, for example). When the anti-rotation device is in final position and the contact is oriented in an operating position, the surface complementary to the external surface of the orientation zone and this external surface of the orientation zone are substantially parallel and/or in contact with one another.

In this manner, it is possible to block the orientation of the orientation zone about the longitudinal axis according to at least one predefined direction. Furthermore, if the contact is not properly oriented about the longitudinal axis, it is possible, during the placement of the anti-rotation device, to mechanically interact with the orientation zone in order to change its orientation about the longitudinal axis. In other words, during the placement of the anti-rotation device, if a contact with which it must interact is not correctly oriented, the anti-rotation device turns it and when the anti-rotation device is in final position, the respective surfaces of the anti-rotation device and of the second portion of contact cooperate to maintain the contact blocked in rotation in the desired position.

The electrical connection device may further comprise one or more of the following features, each considered independently of one another or in combination with one or more others:

- the second portion of the contact comprises two orientation zones each having an external surface that is not completely cylindrical of revolution, these two orientation zones being symmetrical to each other in relation to a plane comprising the longitudinal axis of the first portion of the contact;
- the external surface, not completely cylindrical of revolution, of the two orientation zones is flat and the anti-rotation device comprises at least one surface, complementary to the equally flat external surface of the orientation zones;

the anti-rotation device is secured to the contact by elastic means, causing the anti-rotation device to press the complementary surface of the external surface of the orientation zone against it when the anti-rotation device is in final position;

the elastic means cooperate with a tubular external surface of the housing;

during the displacement of the anti-rotation device in the placement direction, toward its final position, the elastic means exert a resistance which corresponds to a force that increases to a maximum, then decreases;

the maximum of the force is greater than the force needed to move the contact in rotation about the longitudinal axis in any angular position to its operating position;

the anti-rotation device includes positioning means that cooperate with the contact to position the anti-rotation device in relation to the housing in the longitudinal direction; and the anti-rotation device includes a groove for guiding a conductive wire emerging from the housing.

According to another embodiment a method for mounting an electrical connection device is provided, in which a housing is provided, along with at least one contact and an anti-rotation device, and a first portion of contact is inserted into a tubular cavity of the housing extending along a longitudinal axis, and in which the anti-rotation device is fastened to the housing by displacing it in translation in a placement direction, substantially perpendicular to the longitudinal axis, up to a final position in which the anti-rotation device abuts on a second portion of the contact located outside the tubular cavity and blocks the rotation of contact about the longitudinal axis in an operating position.

Optionally, in this method, the anti-rotation device moves the contact in rotation to this position when the anti-rotation device is placed in its final position if the contact is not oriented about the longitudinal axis in the operating position.

BRIEF DESCRIPTION OF THE SEVERAL VIEWS OF THE DRAWING

The present invention will now be described, by way of example with reference to the accompanying drawings, in which.

In these figures, the same references are used to designate identical or similar elements.

DETAILED DESCRIPTION OF THE INVENTION

Figure 1:
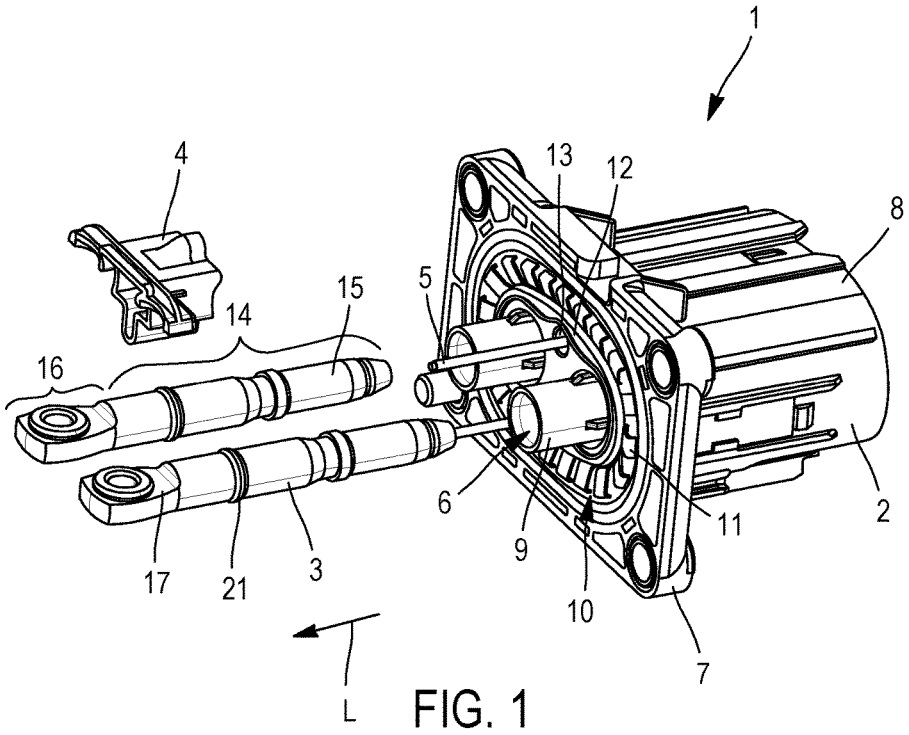
FIG. 1 shows a perspective view of a connection device according to a first embodiment the invention.

FIG. 1 shows a non-limiting example of an embodiment of a connection device 1 according to the invention. This connection device 1 includes a housing 2, two contacts 3, an anti-rotation device 4 and two electrical wires 5.

The housing 2 and the anti-rotation device 4 are formed of an electrically insulating material. They are, for example, molded from a plastic material. In the example illustrated in FIGS. 1*a* to 6*b*, the housing 2 has two tubular cavities 6 extending about a longitudinal axis L, perpendicularly to a flange 7. Each tubular cavity 6 passes longitudinally through a housing body 8 and extends, beyond the flange 7, at the level of a sleeve 9. Shielding 10 is placed in the housing body 8 around the tubular cavities 6 and spring thereof to form a collar 11 extending substantially in a plane perpendicular to the longitudinal axis L. This collar 11 is intended to be compressed between the flange 7 and an electrically conductive support (not represented) whereon the connection device 1 will be mounted. The collar 11 is intended to establish an electrical contact with this support. A seal 12 is also mounted on the connection device 1 to achieve a watertight barrier between the flange 7 and this support.

In the example shown and described in this document, the tubular cavities 6 and the contacts 3 lodged therein are respectively two in number, but the invention may be applied to connection devices having a single contact or more than two contacts.

The electric wires 5 are electrically connected (e.g. crimped) on electric terminals (not visible in the figures), inserted into cavities formed in the housing 2. The electric wires 5 exit through openings 13 in the housing 2, between the contacts 3.

The contacts 3 are formed of a conductive material. For example, they are machined (bar turning) from a bar of copper alloy. The contacts 3 extend along a longitudinal axis L. They have several successive portions along this longitudinal axis L. Notably, a first portion 14 whose external surface 15 is cylindrical of revolution about the longitudinal axis and a second portion 16 which has an orientation zone 17 whose external surface 18 is not cylindrical of revolution about the longitudinal axis L can be defined. More particularly, in the example described in relation to FIGS. 1*a* to 5*b*, the second portion 16 of each contact 3 is flattened and has two orientation zones 17 symmetrical with respect to one another relative to a plane comprising the longitudinal axis of the first portion 14 of each contact 3. Each of these orientation zones 17 have a substantially flat external surface 18. The second portion 16 of each contact 3 has a bore for passing means to secure a cable or a bus bar. A reinforcing ring 20 is crimped in this passage.

The first portion 14 is intended to be inserted into one of the tubular cavities 6 of the housing 2. Here, the first portion 14 is provided with an O-ring 34 mounted in a groove and ensuring a watertight seal between each contact 3 and its tubular cavity 6. The second portion 16 is intended to be connected electrically to a cable or bus bar.

Figure 2:
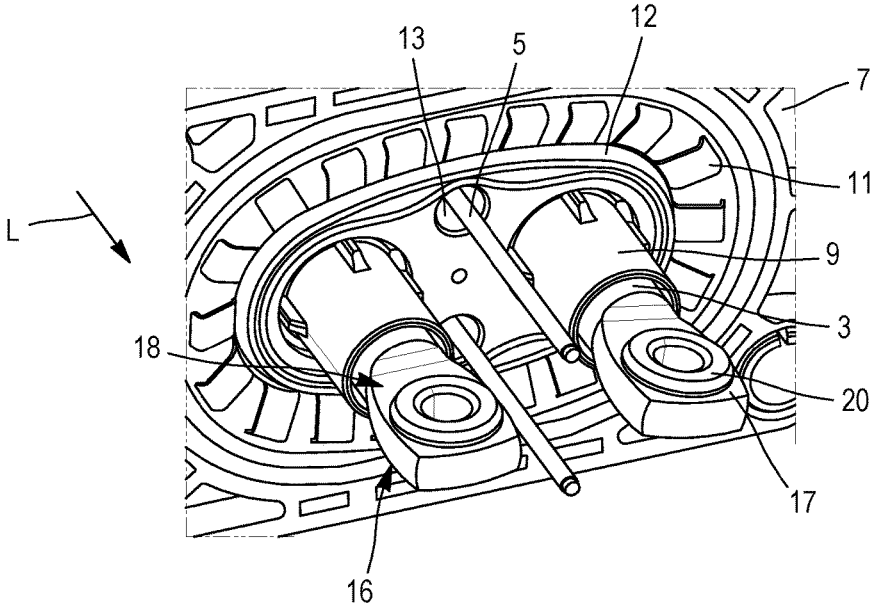
FIG. 2 shows a perspective detail view of the connection device shown in FIG. 1 according to a first embodiment the invention.

As shown in FIG. 2, each second portion 16 projects from the flange 7 and the tubular cavity 6 into which the corresponding contact 3 is inserted. As can be seen in FIG. 2, owing to the symmetry of revolution of the first portion 14 and the internal surface of the tubular cavity 6 into which this contact 3 is inserted, the contact 3 can assume any angular orientation about its longitudinal axis.

In order to define and fix this angular orientation, an anti-rotation device 4 is mounted on the connection device 1.

Figure 3A:
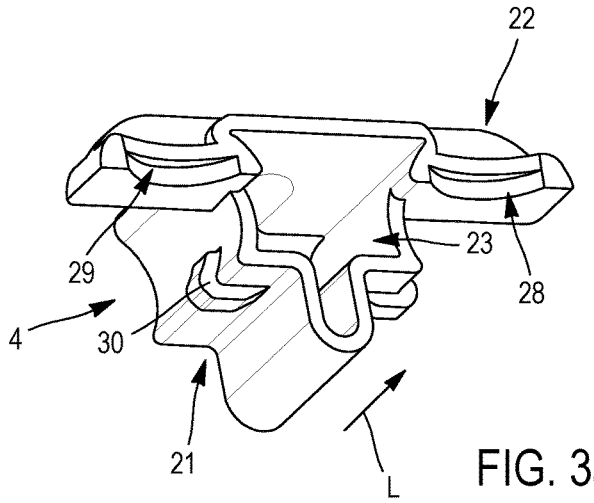
FIGS. 3*a* to 3*c* show perspective views of, an anti-rotation device intended to be mounted on a connection device such as that of FIGS. 1 and 2 from different angles according to a first embodiment the invention.
Figure 3B:
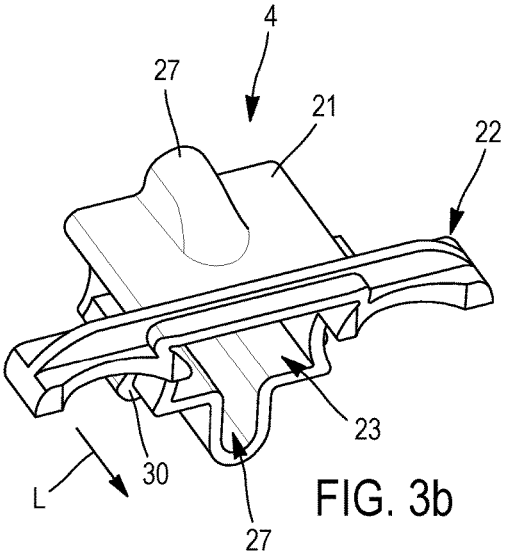
Figure 3C:
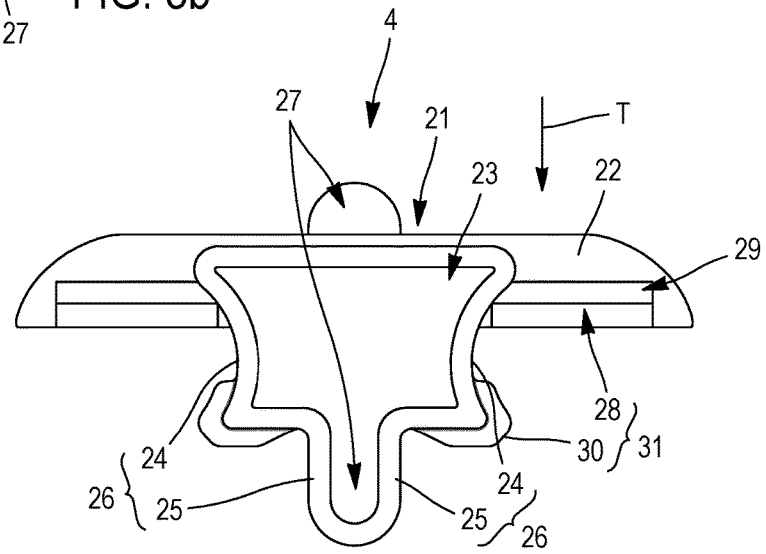

This anti-rotation device 4 is described in more detail in relation to FIGS. 3*a* to 3*c*. Advantageously, the overall dimensions of the anti-rotation device 4 are such that it can be placed inside the sealed zone (limited by the lips of the seal 12 and a limited shielded zone). It has a hollow body 21, from which two wings 22 extend outwardly. The hollow body 21 comprises a cavity 23 which extends in the longitudinal direction L, when the anti-rotation device 4 is mounted on the connection device 1. The hollow body 21 is intended to be inserted between the second portions 16 of the contacts 3, and in the example described here, between the sleeves 9. The shape and the elasticity of the hollow body 21 are such that the anti-rotation device 4 can be clipped onto the sleeves 9. The hollow body 21 can be deformed so as to substantially bring the curved zones 24 towards one another, these zones intended complementarily to conform to the shape of the external surface of the sleeves 9, when the anti-rotation device 4 is in place on the connection device 1. These curved zones 24 and 25, and the parts of the hollow body 21 that link them, thus form elastic means 26. These elastic means 26 exert an action on the contacts 3 tending to press the surfaces of the wings 22 in abutment against the orientation zones 17, when the anti-rotation device 4 is in final position. These elastic means 26 also cooperate with the tubular external surface of the sleeves 9.

Figure 5A:
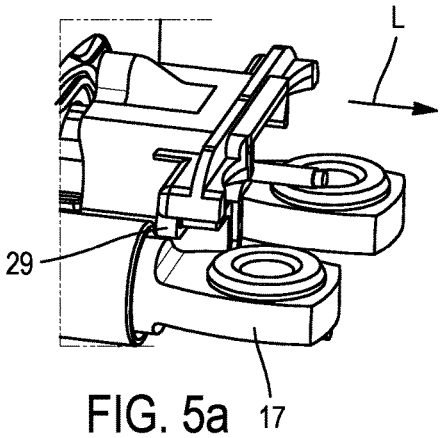
FIGS. 5*a* and 5*b* show perspective views of the anti-rotation device of the previous figures from different angles according to a first embodiment the invention.
Figure 5B:
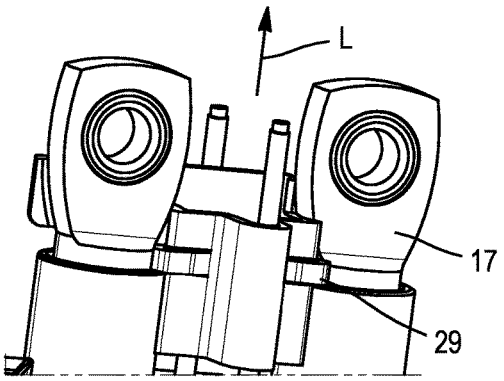

The hollow body 21 has two notches 27, or gutters, aligned in a direction substantially perpendicular to the wings 22. Each of these notches 27 is intended to accommodate, guide and protect an electric wire 5. Each wing 22 has a surface 28, or zone, complementary to an orientation zone 17 of a contact 3. In the example presented here, this surface 28 is flat and oriented perpendicularly to the placement and mounting direction T of the anti-rotation device 4 on the connection device 1. Each wing 22, also has a notch 29 to fix the corresponding contact 3 in a specific position, along the longitudinal direction L, in relation to the anti-rotation device 4. This notch 29 has a rounded and stepped shape so as to match the shape of the reinforcing ring 20. The curved surface of the notch 29 is open towards the outside of the connection device 1 and blocks the movement of the contact 3 in the housing 2 in the direction of the flange 7. Furthermore, the anti-rotation device comprises a rib 30, on each side of the hollow body 21, under each of the wings 22 in order to the fix the anti-rotation device 4 along the longitudinal axis L on the edge of each of the sleeves 9. The position of the contacts 3 along their respective longitudinal axis can thus be precisely defined and respected when mounting the contacts 3 in the housing 2. As can be seen in FIGS. 5*a* and 5*b*, the ribs 30 are placed behind a bulging portion of the orientation zone 17. The ribs 30 thus also block the movements of the contacts 3 in the housing 2 in the direction tending to spread the orientation zones 17 of the flange 7. The notches 29 and the ribs 30 thus form the positioning means 31 for the contacts 3 along the longitudinal axis L.

Figure 4A:
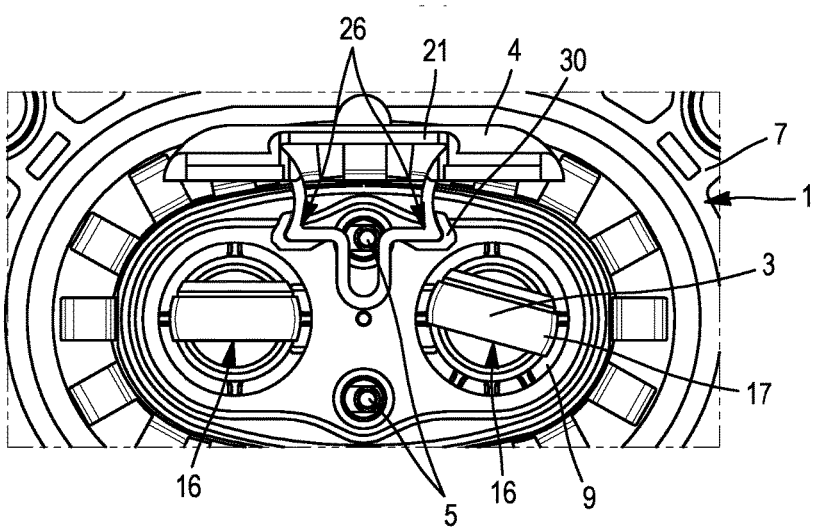
FIGS. 4*a* to 4*c* show front views of the implementation and mounting the anti-rotation device of FIGS. 3*a* to 3*c*, on the connection device of FIGS. 1 and 2 according to a first embodiment the invention.
Figure 4B:
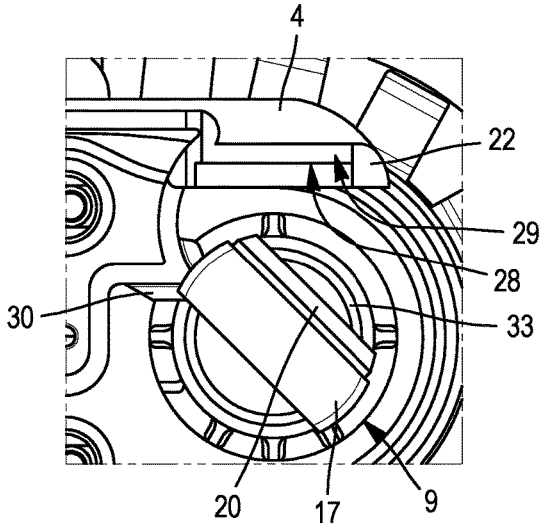
Figure 4C:
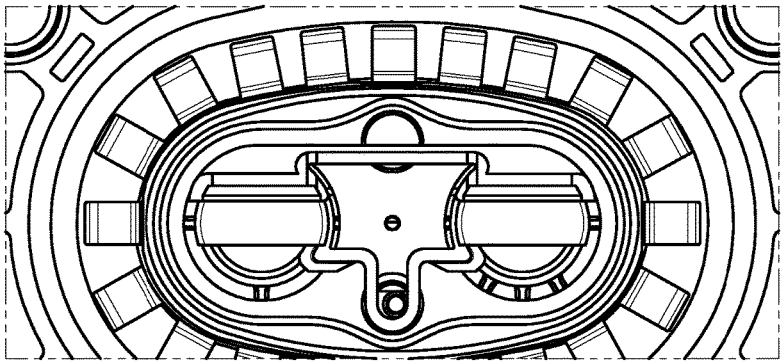

The assembly of the anti-rotation device on the connection device is illustrated in FIGS. 4*a* to 4*c*.

Initially, the anti-rotation device 4 is brought close to the connection device 1. The electric wires 5 are inserted to the centre of the hollow body 21, therethrough. The anti-rotation device 4 is placed substantially above the end of the sleeves 9 and of the orientation zones 17 of the contacts 3 (see FIG. 4*a*). The anti-rotation device 4 is moved perpendicularly to the longitudinal axis L of the contacts 3 and in parallel to the flange 7 by bringing the hollow body 21 between the second portions 16 of the contacts 3. During this movement, in the placement direction T, towards its final position, the elastic means 26 exert a resistance that corresponds to a force that increases to a maximum, then decreases. A "Go-no go" effect is thereby obtained. So, either the anti-rotation device 4 is moved with sufficient force to overcome this maximum force and the anti-rotation device 4 automatically moves into the final position through elastic means 26; or this force is insufficient and the anti-rotation device 4 is not at all maintained on the connection device 1. The anti-rotation device 4 therefore cannot be incorrectly positioned on the connection device 1. Furthermore, the maximum amount of force is greater than the force required to move the contact 3 in rotation about the longitudinal axis L of any angular position to its operating position. The movement of the anti-rotation device 4 to its final position thus involves the automatic correction of the orientation and the position of the contact 3. During the placement of the anti-rotation device 4, if the orientation zones 17 are not properly oriented and positioned about and along the longitudinal axis of the contacts 3, the flat surface 28 of wings 22 cooperate, in a complementarily manner, with the surfaces of the orientation zones 17, on the one hand, and the ribs 30 and the notches 29 cooperate with the edge 33 of the ends of the sleeves 9 and with the reinforcement rings 20 (see FIG. 4*b*), respectively, on the other hand. When the anti-rotation device 4 is in place on the connection device 1, the contacts 3 are fixed in rotation and in translation by the anti-rotation device 4 (see FIGS. 4*c*, 5*a* and 5*b*).

Figure 6A:
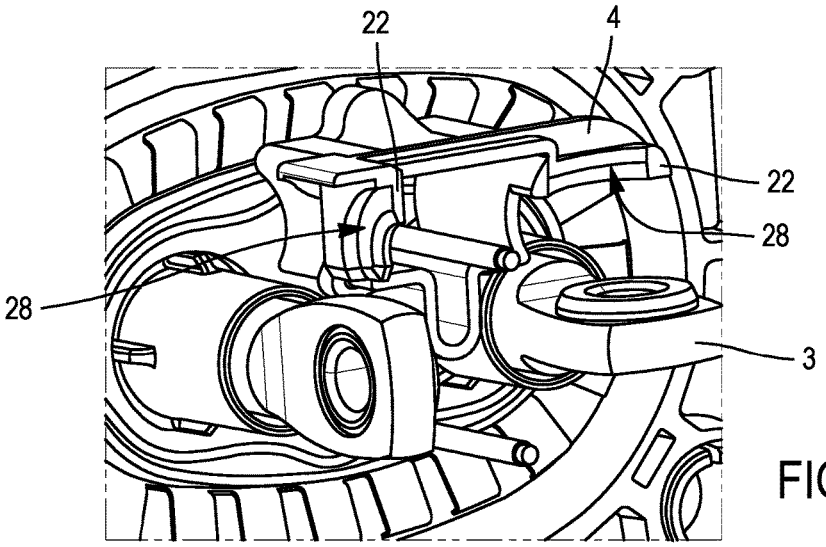
FIGS. 6*a* and 6*b* show perspective views of an anti-rotation device in pre-assembly position and final position, respectively, on a connection device similar to that of FIGS. 1 and 2 according to a second embodiment the invention.
Figure 6B:
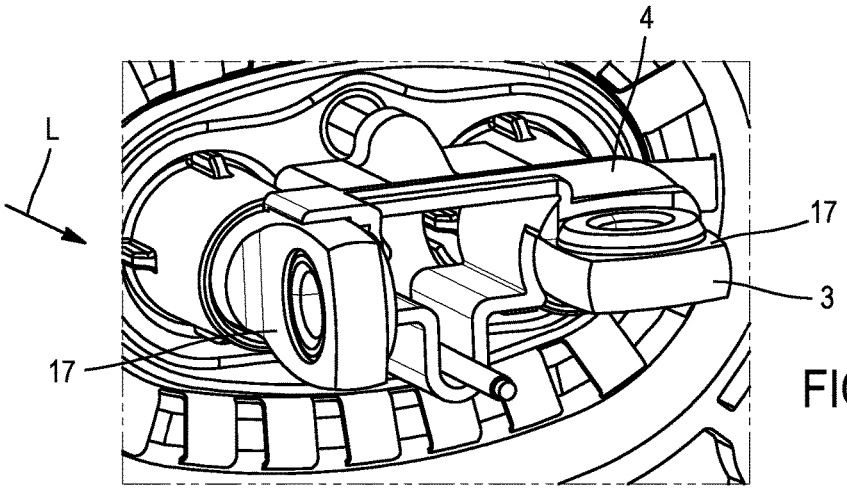

According to a variant illustrated in FIGS. 6*a* and 6*b*, the anti-rotation device 4 comprises wings 22 oriented at 90°, about their respective longitudinal L, in relation to one another. In other words, their flat surfaces 28 are perpendicular to each other. The principle for the placement and control of the orientation and position of the contacts 3 is, however, the same as that described above in relation to FIGS. 4*a* to 4*c*. When the anti-rotation device 4 is in final position (see FIG. 6*b*), the contacts 3 and their respective orientation zones 17 are oriented at 90° in relation to one another about the longitudinal axis L.

According to non-illustrated variants, the anti-rotation device 4, instead of being positioned partly on the sleeves 9 and partly on the contacts 3, as explained above, may be positioned only on the sleeves 9 or only on the contacts 3.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connection device, comprising:

a housing having a tubular cavity;

a contact having a first portion and a second portion, the first portion having a cylindrical first external surface oriented about a longitudinal axis and being inserted into the tubular cavity of the housing and the second portion extending outside the tubular cavity and having an orientation zone with a second external surface that is partially, but not completely, cylindrical about the longitudinal axis; and an anti-rotation device, displaceable in translation in a placement direction, substantially perpendicular to the longitudinal axis of the first portion of the contact, up to a final position, and having a first surface complementary to the second external surface of the orientation zone and abutting thereon when the anti-rotation device is in the final position and the contact is oriented in an operating position, wherein the second portion of the contact comprises two orientation zones each having a third external surface that is partially, but not completely, cylindrical, said two orientation zones being symmetrical to each other in relation to a plane including the longitudinal axis of the first portion of the contact, and wherein the third external surface is flat and the anti-rotation device comprises a second surface complementary to the third external surface of the orientation zone, which is also flat.

2. The electrical connection device according to claim 1, wherein the anti-rotation device is secured to the electrical connection device by elastic means, causing the anti-rotation device to press against a complementary surface of the third external surface of the orientation zone abutting thereon when the anti-rotation device is in the final position.

3. The electrical connection device according to claim 2, wherein the elastic means cooperate with a tubular fourth external surface of the housing.

4. The electrical connection device according to claim 2, wherein, during a displacement of the anti-rotation device according to the placement direction, toward the final position, the elastic means exert a resistance corresponding to a force that increases to a maximum, then decreases.

5. An electrical connection device, comprising:

a housing having a tubular cavity;

a contact having a first portion and a second portion, the first portion having a cylindrical first external surface oriented about a longitudinal axis and being inserted into the tubular cavity of the housing and the second portion extending outside the tubular cavity and having an orientation zone with a second external surface that is partially, but not completely, cylindrical about the longitudinal axis; and an anti-rotation device, displaceable in translation in a placement direction, substantially perpendicular to the longitudinal axis of the first portion of the contact, up to a final position, and having a first surface complementary to the second external surface of the orientation zone and abutting thereon when the anti-rotation device is in the final position and the contact is oriented in an operating position, wherein the second portion of the contact comprises two orientation zones each having a third external surface that is partially, but not completely, cylindrical, said two orientation zones being symmetrical to each other in relation to a plane including the longitudinal axis of the first portion of the contact, wherein the anti-rotation device is secured to the electrical connection device by elastic means, causing the anti-rotation device to press against a complementary surface of the third external surface of the orientation zone abutting thereon when the anti-rotation device is in the final position, wherein, during a displacement of the anti-rotation device according to the placement direction, toward the final position, the elastic means exert a resistance corresponding to a force that increases to a maximum, then decreases, and wherein the maximum of the force is greater than the force required to move the contact in rotation about the longitudinal axis of any angular position to the operating position.

6. The electrical connection device according to claim 1, wherein the anti-rotation device comprises positioning means that cooperate with the contact to position the anti-rotation device in relation to the housing in a longitudinal direction.

7. The electrical connection device according to claim 1, wherein the anti-rotation device comprises a gutter to guide a conductive wire emerging from the housing.

8. A method for mounting an electrical connection device, comprising the steps of:

providing a housing having a tubular cavity and at least one contact;

inserting a first portion of the at least one contact into the tubular cavity of the housing extending along a longitudinal axis; and fastening an anti-rotation device having an orientation zone with an external surface that is not completely cylindrical of revolution about the longitudinal axis to the housing by a translational movement in a placement direction substantially perpendicular to the longitudinal axis from an initial position to a final position in which the anti-rotation device abuts a stop on a second portion of the at least one contact located outside the tubular cavity and blocks a rotation of a contact about the longitudinal axis in an operating position, wherein a second portion of the at least one contact comprises two orientation zones each having an external surface that is not completely cylindrical of revolution, said two orientation zones being symmetrical to each other in relation to a plane including the longitudinal axis of the first portion of the at least one contact, wherein the external surface is not completely cylindrical of revolution of each of the two orientation zones, wherein the external surface is flat, and wherein the anti-rotation device comprises at least one surface complementary to the external surface of the orientation zones which is also flat.

9. The method according to claim 8, wherein the anti-rotation device moves the at least one contact in rotation to this position when the anti-rotation device is placed in the final position if the at least one contact is not oriented about the longitudinal axis in the operating position.

* * * * *